US008668082B2

(12) United States Patent
Greene et al.

(10) Patent No.: US 8,668,082 B2
(45) Date of Patent: Mar. 11, 2014

(54) FLEXIBLE PACKAGING

(75) Inventors: Pamela S. Greene, Portland, OR (US); James E. Goddard, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 541 days.

(21) Appl. No.: 12/570,025

(22) Filed: Sep. 30, 2009

(65) Prior Publication Data

US 2011/0073502 A1 Mar. 31, 2011

(51) Int. Cl.
*B65D 5/64* (2006.01)

(52) U.S. Cl.
USPC ..... 206/292; 229/148; 229/149; 229/120.06; 229/120.23; 229/120.35; 229/120.38

(58) Field of Classification Search
USPC ..... 229/142, 149, 150, 120.34, 120.23, 229/137, 125.39, 165, 169, 170, 177, 178, 229/181, 120.35, 120.38, 120.06, 148
See application file for complete search history.

(56) References Cited

U.S. PATENT DOCUMENTS

| | | | | | |
|---|---|---|---|---|---|
| 225,013 | A | * | 3/1880 | Knobeloch | 229/117.26 |
| 926,208 | A | * | 6/1909 | Palmer | 229/149 |
| 1,067,948 | A | * | 7/1913 | Streit | 229/149 |
| 1,341,429 | A | * | 5/1920 | Lewis | 229/125.28 |
| 1,700,432 | A | * | 1/1929 | Cahill | 229/120.35 |
| 1,818,030 | A | | 8/1931 | Arnold | |
| 1,974,156 | A | | 9/1934 | Hockmeyer | |
| 1,997,637 | A | | 4/1935 | Gebelein | |
| 2,119,490 | A | | 5/1938 | Pellerin | |
| 2,154,536 | A | | 4/1939 | Sebastian | |
| 2,276,765 | A | | 3/1942 | Gree | |
| 2,333,643 | A | | 11/1943 | Donnellan | |
| 2,497,325 | A | | 2/1950 | Scherba | |
| 2,517,767 | A | * | 8/1950 | Cody | 229/120.23 |
| 2,672,263 | A | | 3/1954 | Alber | |
| 2,923,455 | A | * | 2/1960 | Tingley | 229/117.13 |
| 2,985,297 | A | | 5/1961 | Berry et al. | |
| 3,229,819 | A | | 1/1966 | Berk | |
| 3,288,349 | A | * | 11/1966 | Palmer et al. | 229/149 |
| 3,369,660 | A | | 2/1968 | Hartman | |
| 3,675,345 | A | * | 7/1972 | Abrams | 434/403 |
| 3,924,801 | A | * | 12/1975 | Partain | 229/168 |
| 4,005,815 | A | * | 2/1977 | Nerenberg et al. | 229/117.17 |
| 4,126,256 | A | | 11/1978 | McGruder | |
| 4,535,929 | A | * | 8/1985 | Sherman et al. | 229/142 |
| 4,903,431 | A | * | 2/1990 | Stoll | 47/29.2 |
| 5,190,155 | A | * | 3/1993 | Grunwald | 206/459.1 |
| 5,193,671 | A | * | 3/1993 | Patterson | 206/756 |
| 5,414,975 | A | | 5/1995 | Hummel | |
| 5,662,222 | A | * | 9/1997 | Thayer et al. | 206/387.1 |
| 6,467,613 | B2 | | 10/2002 | Felsenthal | |
| 7,581,643 | B2 | * | 9/2009 | Wilskey et al. | 206/736 |
| 2006/0168915 | A1 | | 8/2006 | Downing-Perrault et al. | |
| 2006/0185993 | A1 | | 8/2006 | Wilskey et al. | |

FOREIGN PATENT DOCUMENTS

| | | |
|---|---|---|
| CH | 676783 | 3/1991 |
| FR | 2696717 | 4/1994 |
| JP | 1267123 | 10/1989 |

* cited by examiner

*Primary Examiner* — Tri Mai
(74) *Attorney, Agent, or Firm* — Banner & Witcoff, Ltd.

(57) ABSTRACT

Various arrangements for a flexible package for articles of footwear or other items are presented. The flexible package generally includes a lightweight flexible package sized to accommodate a pair of shoes. The flexible package may also include a removable stiffening insert to aid in maintaining the structure of the flexible package and allow stacking of the package. Further, the flexible package may include one or more handle arrangements. Various closure arrangements may be used with the flexible packaging for footwear, such as an undercut tab arrangement, hook and loop type closure arrangement, rim and lip, and the like.

25 Claims, 13 Drawing Sheets

FLEXIBLE PACKAGING

FIELD OF THE INVENTION

This invention relates generally to flexible packaging for articles, such as articles of footwear, equipment and apparel. In particular, the invention relates to flexible packaging for a pair of shoes that is lightweight, stackable, uses less material than conventional packaging and includes a handle for ease of carrying.

BACKGROUND

For years shoes have been packaged and sold in a conventional box. The boxes are generally made of cardboard, but they can be made of other materials, such as rigid plastic. While this arrangement is convenient for stacking shoes, etc., the boxes can be bulky and are not convenient for carrying unless they are placed in a bag or other device having a handle. In addition, shoe boxes are generally opaque, which prevents the consumer from viewing the shoe within the package. Further, shoe boxes often require a considerable amount of material, which leads to additional cost of manufacturing, as well as to added weight during transport (e.g., from the manufacturer or by the consumer) and creates a considerable amount of waste when the boxes are disposed.

Generally, in order to be stacked, conventional shoe boxes must be rigid so they do not wrack and collapse under the weight of boxes above them. In addition, shoe boxes generally avoid protrusions extending outward that may catch on other boxes when pulling one box out of a stack of boxes. In some arrangements, shoe boxes may be conveyed through distribution centers in which individual boxes are exposed to a variety of surfaces, such as rollers and belts, and to transitions between these surfaces during directional and speed changes. Conventional shoe boxes require substantial material and structure in order to be robust enough to make this passage and not catch on, or bind between, conveyance structures.

Additionally, corrugate packaging is often the largest single material waste stream of a consumer products company, and the unencumbered recycling of this waste stream is a paramount objective. Legislation and punitive taxation against permanently mixed materials packaging exists in certain countries, so packages must be constructed so that they are made of one material only, or if different materials are used, such as a lightweight exterior and stronger internal support, that the different materials are easily removed from one another during recycling.

Accordingly, a flexible package having reduced material usage, increased ease of recycling while maintaining a structure suitable for conveyance, distribution and sale of the product within the package would be advantageous.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

Aspects of this invention relate to flexible packages for articles of footwear, equipment and apparel. Generally, the flexible package includes a main body portion configured from a plurality of panels. One or more panels may be flat and one or more panels may include a seam, crease, fold line, and the like. The flexible package may include one or more handles. In some arrangements, the handle may be arranged on one end of the flexible package and may be a suitable length to carry the package in the hand of a user or to pull the package from a storage position, such as a stack of packages.

The flexible package generally includes at least one panel configured to allow access to the interior of the flexible package. This panel may include a closure mechanism that may couple to a corresponding closure mechanism on one or more other panels of the flexible package. In addition, one or more panels may be gusseted to add support to the panel. A removable stiffening insert may be included to aid in maintaining the structure of the flexible package, as well as for maintaining the separation of footwear or other articles within the flexible package. Since the quick recycling of the waste package is desirable, differing materials (such as materials used of a stiffening insert that may be different from the materials forming the flexible package) are not, in some examples, permanently affixed so that they may be separated into different waste streams.

BRIEF DESCRIPTION OF THE DRAWINGS

A more complete understanding of the present invention and certain advantages thereof may be acquired by referring to the following detailed description in consideration with the accompanying drawings, in which.

Figure 1A:
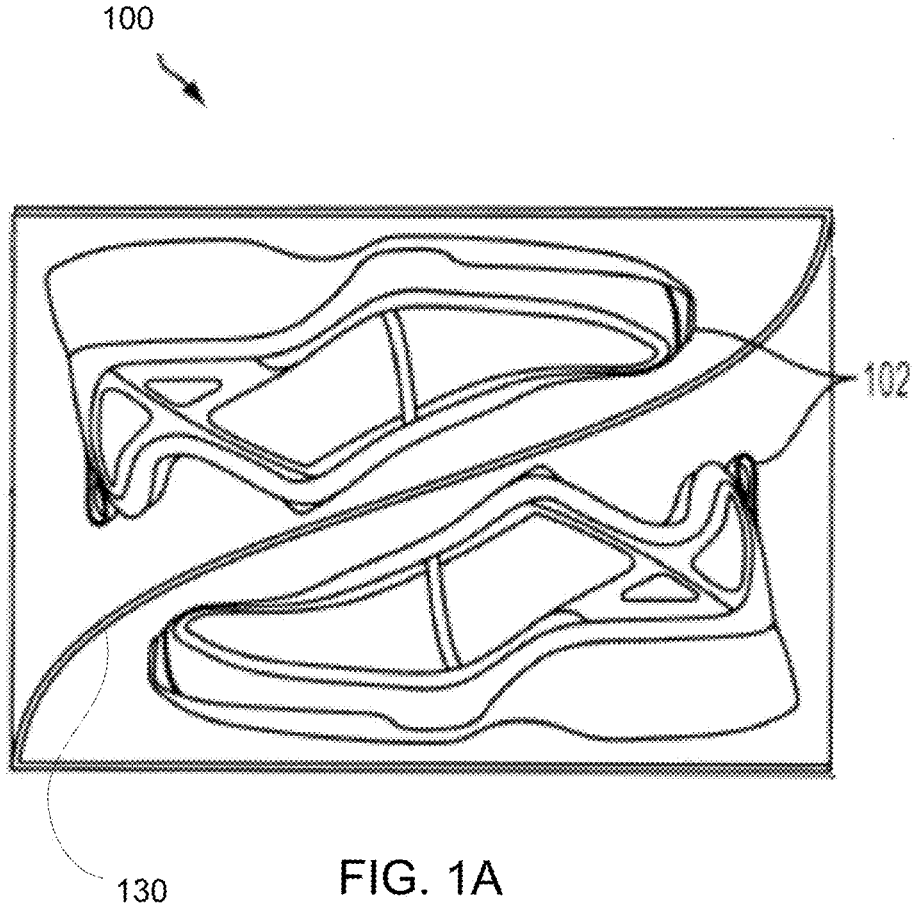
FIG. 1A is a top view of a flexible package for footwear according to at least some aspects of this invention shown in a stacked configuration.

The reader is advised that the attached drawings are not necessarily drawn to scale.

DETAILED DESCRIPTION

In the following description of various example structures in accordance with the invention, reference is made to the accompanying drawings, which form a part hereof, and in which are shown by way of illustration various example articles, including one or more flexible packaging arrangements. Additionally, it is to be understood that other specific arrangements of parts and structures may be utilized, and structural and functional modifications may be made without departing from the scope of the present invention. Also, while the terms "top," "bottom," "front," "back," "rear," "side," "underside," "overhead," and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of this invention. Further, the invention generally will be described as it relates to flexible packaging for articles of footwear. However, aspects of the invention may be used for containing a variety of articles, including footwear, equipment and apparel, as well as boxes such as gift boxes, and nothing in the specification or figures should be construed to limit the invention to use with articles of footwear. As used herein, the term flexible means pliable, likely to yield or capable of being adapted, flexed or bent without breaking.

A. General Description of Flexible Packaging for Articles of Footwear or Other Elements According to the Invention In general, as described above, aspects of this invention relate to flexible packaging for articles of footwear or other elements. More detailed descriptions of aspects of this invention follow.

1. Example Flexible Packages for Articles of Footwear or Other Elements, According to the Invention Aspects of this invention relate to flexible packaging that may be used, for example, for articles of footwear. The flexible packaging generally includes a main storage portion formed from a plurality of panels. In at least some examples, one or more panels are flat to aid in conveyance, stacking, etc. of the flexible packages. In addition, one or more panels may be seamed or creased to provide stiffening features and/or to allow those panels to fold predictably, thereby collapsing the flexible package to a size smaller than the expanded size. In at least some examples, the flexible package includes a front panel, a rear panel and a plurality of side panels that generally enclose and define a void created by the flexible package. At least one of the panels may be configured to open to provide access to the void.

The flexible package may include one or more handles configured for carrying the flexible package. In some arrangements, the handle may be connected to one or more panels of the main storage portion and may be arranged around an exterior of the flexible package during transport and/or storage of the flexible package. Alternatively, if desired, the handle may be configured to be stowed in an interior of the flexible package during transport and/or storage. The handle may be any suitable size or length, and in some examples, it may be sized to be carried in the hand of a user.

In at least some arrangements, the flexible package handle may be configured on an exposed side of the flexible package. The handle of these examples may be used to aid in removal of the flexible package from a stack of flexible packages, i.e., in a shoe store or storage facility or to carry the flexible package in the hand of a user or from a stack of mixed packages including both flexible packages and conventional boxes. The handle of any of the arrangements described may be integrally formed with one or more panels of the main storage portion or, in some examples, may be formed as a separate piece and connected to one or more panels of the main storage portion using known attachment techniques.

In some examples, the flexible packaging includes a closure mechanism to secure and close the panel providing access to the void to the main storage portion of the flexible package. The closure mechanism (or at least portions thereof) may be formed on one or more panels of the package.

In at least some examples, a portion of the closure mechanism is formed on a top panel and a corresponding portion of the closure mechanism is formed on a front panel. In other examples, the edge of a top surface may include reinforcements that mate with one or more side panels of the package to close the package. Other closure structures and mechanisms are possible without departing from this invention.

In some examples, a removable stiffening insert may be included to aid in maintaining the structural integrity of the flexible package, as well as for maintaining the separation of footwear members within. This removable stiffening insert may, in some arrangements, provide strength under compression to maintain the structure of the flexible package when stacked, for instance, vertically. In some examples, the removable stiffening insert may permit the flexible package to be formed of very thin lightweight materials, for an overall package weight reduction. Additionally or alternatively, the removable stiffening insert may provide taughtness and surface integrity to at least the bottom surface of the package during individual conveyance. Further, the removable stiffening insert may be flexible and may include multiple bends or predetermined flex points that may permit the insert to fully articulate and flex to conform around the forms of the shoes or internal contents.

In some examples, the flexible package is formed of a high strength yet flexible material, such as polyester plastic films or textiles, and it may be made (at least partially) from a transparent material to allow the footwear (or other article) within the package to be visible. In other examples, the flexible package may be translucent or opaque to limit the visibility of the footwear (or other article) within the package. The flexible package may also include a label region on which information about the footwear or other contained article may be printed or onto which a label may be placed to provide this information. As another example, if desired, the plastic material of the package may be made from a suitable material so as to allow a label or other indicia to be printed directly thereon.

Additional aspects and specific examples of the articles described above will be described in detail more fully below. The reader should understand that these specific examples are set forth merely to illustrate examples of the invention, and they should not be construed as limiting the invention.

B. Specific Examples of the Invention

Figure 1B:
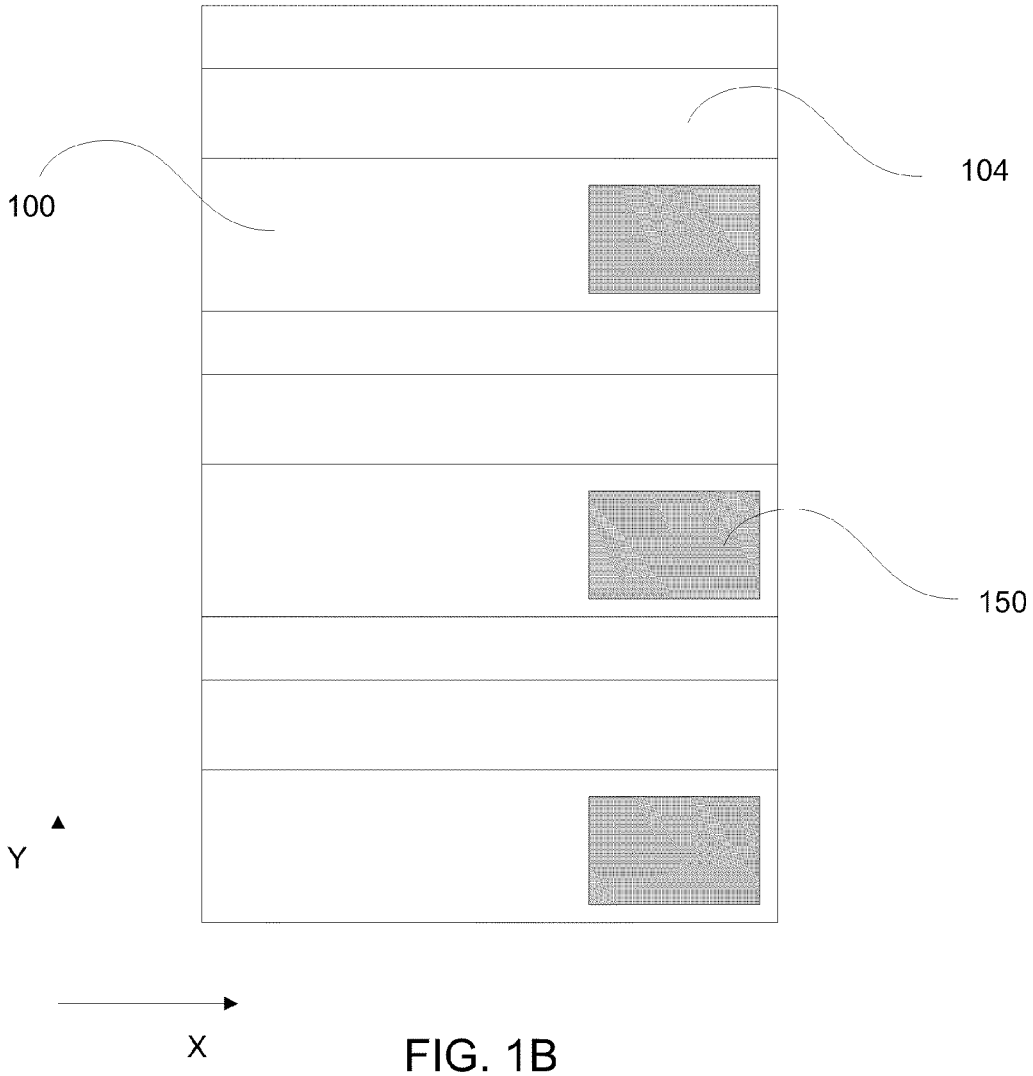
FIG. 1B illustrates a plurality of packages in a stacked configuration in which at least one of the packages is a flexible package according to at least some aspects of this invention.

FIGS. 1A and 1B generally illustrate an example flexible package 100 for articles of footwear or other items. FIG. 1A illustrates the flexible package 100 as shown from a top view, while FIG. 1B illustrates the flexible package 100 in a stacked configuration. The top view of FIG. 1A shows the articles of footwear 102 contained within the flexible package 100, as well as a removable stiffening insert 130 that will be discussed more fully below. The additional packages within the stack in FIG. 1B may also be flexible packages similar to flexible package 100, or may be conventional boxes, such as shoe boxes. The arrangement shown includes a flexible package 100 having a handle 104 and, in some arrangements, a removable stiffening insert 130, as will be described more fully below. The flexible package 100 shown is formed of distinct panels forming distinct edges when joined. These distinct edges may decrease sliding and/or undesired rotation during conveyance and may also allow for improved stackability. Additionally or alternatively, the distinct edges may be void of any protrusions or other portions extending outward from the edges that may catch during distribution, conveyance, or removable of a flexible package from a stack of packages. The stacked configuration shown in FIG. 1B may illustrate one arrangement in which flexible packages may be stacked during transport and/or storage, e.g., in the same manner that conventional shoe boxes are stacked. The stackability of the flexible packages 100 may allow for convenient storage of the packages 100 and may allow for easy scanning of the packages for inventory, price alterations, etc. For example, several flexible packages 100 may be stacked in the same direction with a label or other identifier 150 visible and accessible (e.g., at an exposed edge). When needed, a scan of the labels 150 can be easily performed with the flexible packages 100 in this stacked configuration. In some arrangements, the flexible package 100 may include a passive or active radio frequency identification tag (RFID), or similar tracking and information storage and retrieval system. Such RFID and/or information storage systems are generally known in the art.

The flexible package 100 includes a pair of shoes 102. The shoes 102 may be any type of footwear, including athletic shoes (such as sneakers, cleats, bicycling shoes, etc.), dress shoes for men or women, casual shoes, and the like. Although the flexible packages will be described herein in use with footwear, the flexible packages may be used to store, sell, etc. any article such as athletic equipment, apparel, and the like. In some arrangements, the flexible package may be used for general boxes, such as gift boxes, and the like. As will be discussed more fully below, the flexible packaging arrangements described herein provide an easily stackable package for footwear or other articles. The flexible package may also be slidable to allow removal of a package from a stack of packages without requiring the dismantling of the stack. For instance, the handle 104 may be pulled to slide the flexible package out from a stack, such as the stack shown in FIG. 1B. Further, the flexible package may be durable enough to protect the contents of the package.

As mentioned above, the flexible package may include a handle 104. The handle may be connected to one end or multiple sides or ends of the flexible package 100. The handle 104 may, in some arrangements, be flush with the flexible package 100 in order to avoid the handle 104 catching on other boxes, etc. during storage, conveyance, and the like. The handle may be configured to permit a hand of a user to fit between the handle 104 and the flexible package 100 in order to grab the handle and pull the flexible package 100 out of a stack, carry the flexible package 100, etc.

In some arrangements, one or more handles may be seamed or creased to permit handle 104 to fold predictably, thereby collapsing along with the flexible package to a size smaller than the expanded size, as will be discussed more fully below. The handle 104 may be integrally formed with the remainder of the flexible package 100 or a portion of the flexible package and a unitary piece or may, in other examples, be formed separately from the flexible package 100. In still other arrangements, the handle 104 may be removable.

In some arrangements, as will be discussed more fully below, the flexible package 100 may be wider than it is tall. For example, the package may have a greater length in an X dimension (as shown in FIG. 1B) than in a Y dimension (also shown in FIG. 1B). This arrangement aids in ease of stackability for storage, distribution, conveyance, etc.

Figure 1C:
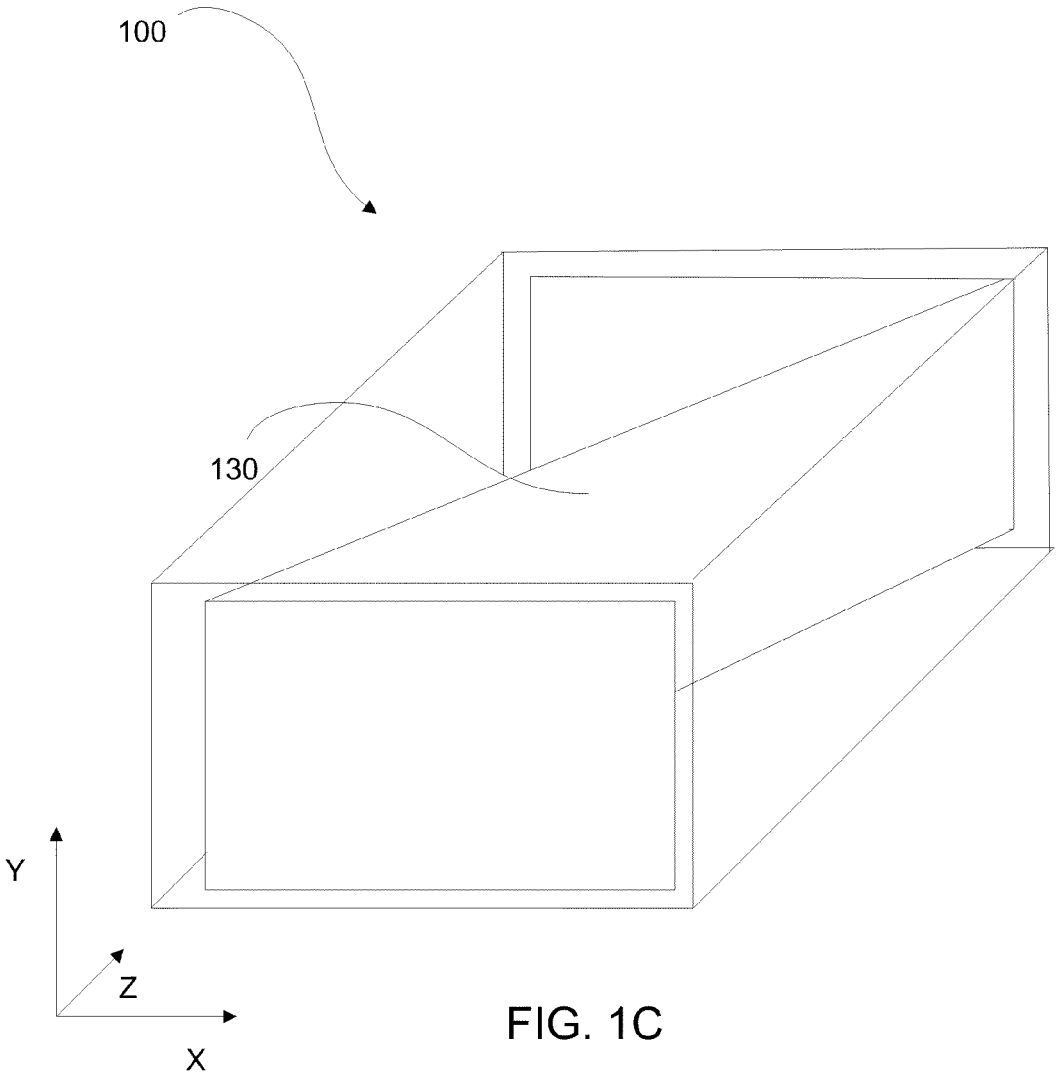
FIG. 1C is a perspective view of the flexible package of FIG. 1A with the articles of footwear removed in accordance with at least some aspects of the invention.
Figure 1D:
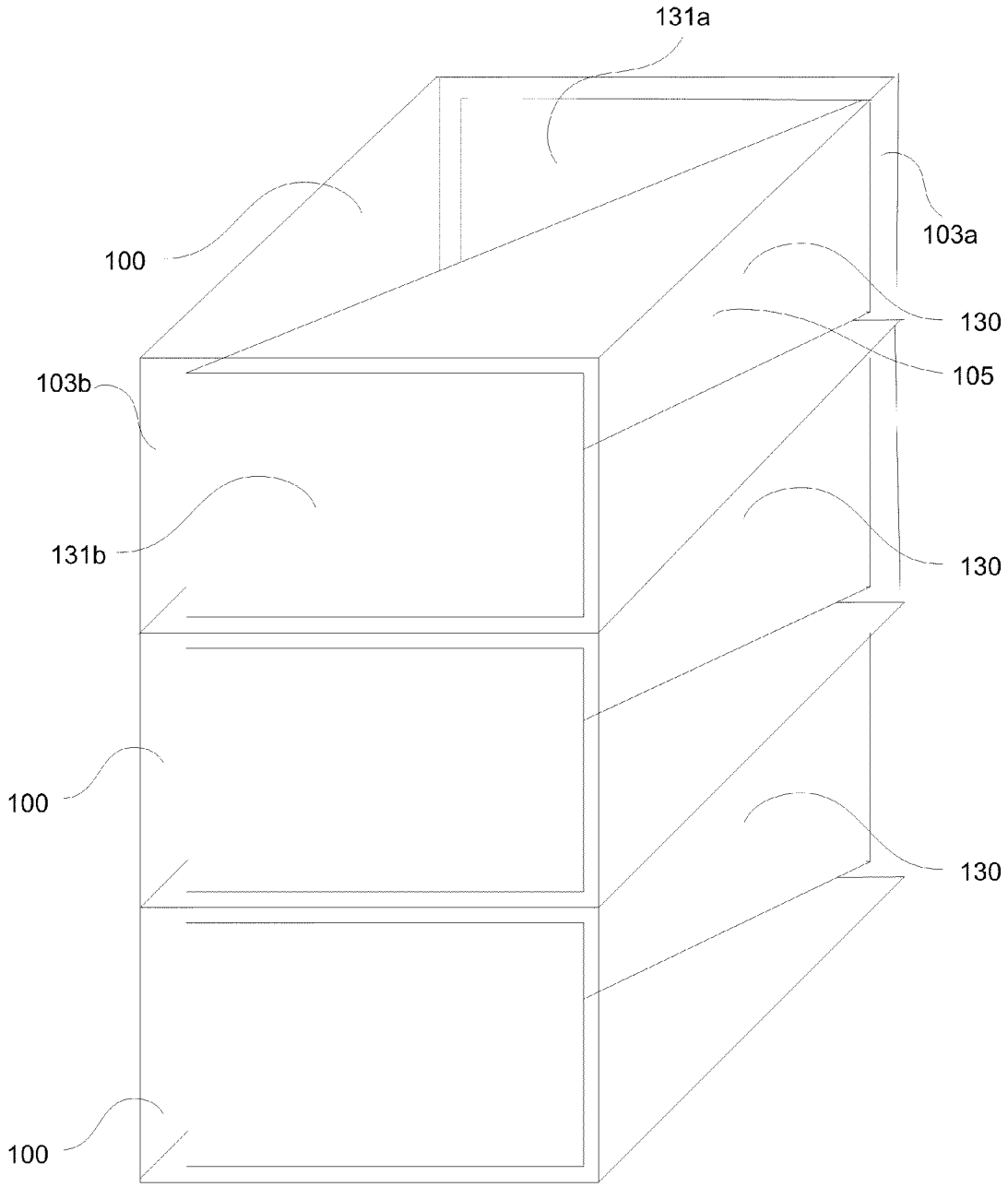
FIG. 1D is a perspective view of multiple flexible packages of FIG. 1C stacked in a top to bottom configuration in accordance with at least some aspects of the invention.

FIG. 1A illustrates a top view of the flexible package 100 in which the articles of footwear 102 and removable stiffening insert 130 are visible. In some arrangements, the top surface of the flexible package 100 may be removable or may be folded back to allow access to the interior of the flexible package 100. FIG. 1C is a perspective view of the flexible package 100 of FIG. 1A with the articles of footwear 102 removed but with one example removable stiffening insert 130 within the package 100. Additional details of the removable stiffening insert will be discussed more fully below. However, in some arrangements, the removable stiffening insert 130 may have increased or substantially greater strength and/or stiffness in a y dimension (as shown in FIGS. 1B, 1C) than in an x dimension (as shown in FIGS. 1B, 1C) and/or z dimension (shown in FIG. 1C). That is, as flexible packages 100 are stacked in a top to bottom fashion, as shown in FIG. 1D, (i.e., with the top surface of one package in contact with a bottom surface of an adjacent package), the removable stiffening insert 130 may provide structure and strength to reduce or prevent crush or collapse of the flexible packages 100.

The removable stiffening insert 130 may include two end panels 131*a*, 131*b* (i.e., the top portion and bottom portion of a letter "Z," in some arrangements) that correspond to end or side panels 103*a*, 103*b* of the flexible package 100. In addition, the central portion 105 of the removable stiffening insert 130 (i.e., the diagonal portion of the letter "Z," in some arrangements) may extend between the two end panels 131*a*, 131*b* and across all or substantially all of the interior of the flexible package. That is, the central portion 105 may extend from a first end of the first end panel 131*a* to a second, opposite end of the second end panel 131*b*. Correspondingly, the central portion 105 may extend diagonally or substantially diagonally across the interior of the flexible package 100 from a first corner of the first side or end panel 103*a* to a second, opposite corner of the second side or end panel 103*b*. This arrangement aids in adding structure and strength to the flexible package 100 in stacked configurations and generally.

Figure 2A:
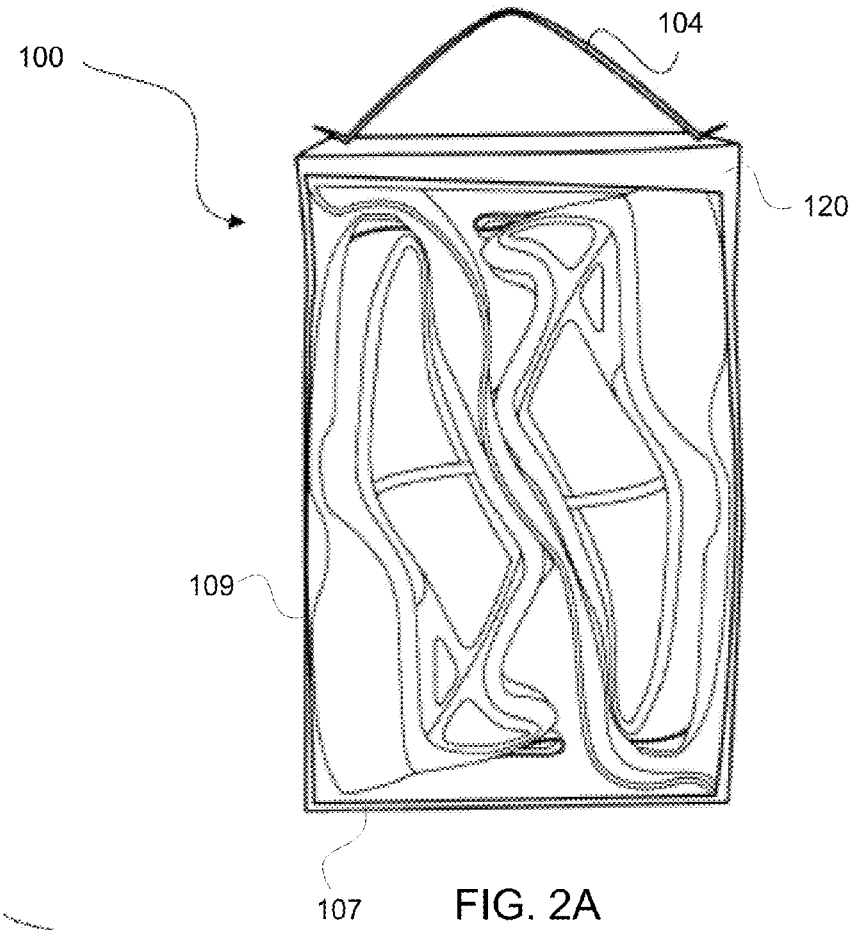
FIGS. 2A and 2B further illustrate the flexible package of FIGS. 1A and 1B including additional features according to at least some aspects of this invention.
Figure 2B:
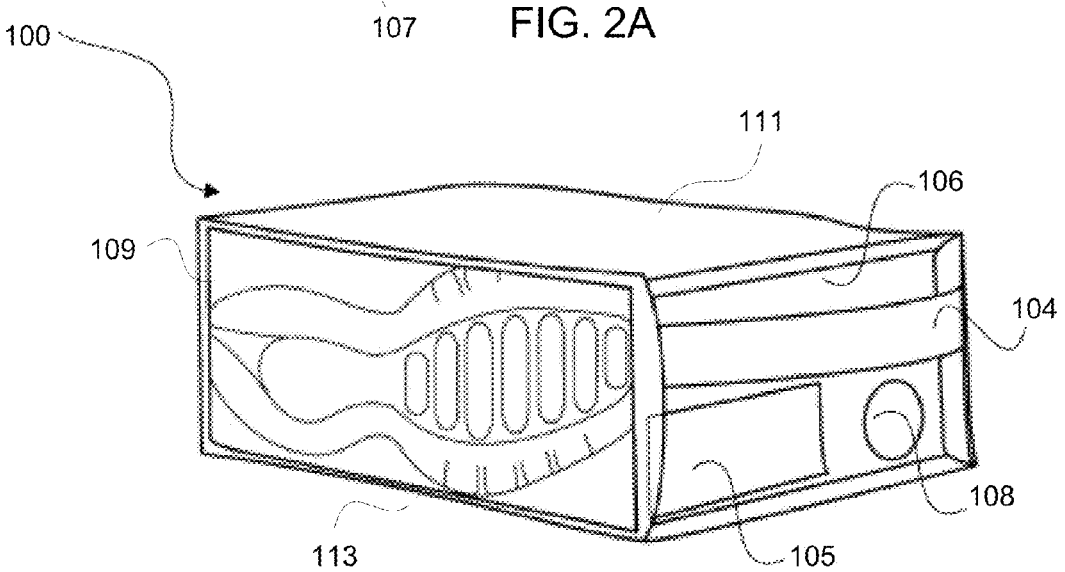

With further reference to FIGS. 1A and 1B, as well as with reference to FIGS. 2A and 2B, the flexible package 100 may include a main storage portion 120 sized to contain the article of footwear 102 or other articles within the flexible package 100. For instance, the main storage portion may contain a pair of shoes 102 and, in some arrangements, the footwear 102 may be positioned with the outsoles of the shoes facing the outer sides or top and bottom panels of the flexible package 100. In another arrangement, if desired, the footwear 102 may be arranged with the outsoles of the shoes directly facing one another (e.g., within the interior of the flexible package 100).

The main storage portion 120 may be formed from the plurality of panels forming the flexible package 100. For instance, the flexible package 100 may include a first end 106 (which may be a front end), a second end 107 (which may be a rear end), and one or more side panels 109. In some arrangements, the one or more side panels may include a top panel 111 and a bottom panel 113. The panels together form the flexible package 100. In some arrangements, some or all of the panels may have a predefined fold line or crease to aid in collapse of the package, as will be discussed more fully below. Additionally or alternatively, one or more of the panels may open to permit access to the main storage portion 120. In still other arrangements, the edges where some or all of the panels connect may be discrete edge, to further aid in collapse of the package, as well as with conveyance of the package because the discrete edges will be less likely to be caught in conveyance structures, such as conveyor rollers, than a loose edge.

FIG. 2A is a front view of one the flexible package 100. The flexible package 100 shown is generally transparent, thereby allowing a person to see what is contained within the package 100. However, in other arrangements, the flexible package 100 may be translucent or opaque. Additionally or alternatively, portions of the flexible package 100 may be transparent while other portions may be translucent or opaque. In one arrangement, most of the flexible package 100 may be transparent while a label region, such as region 105, is opaque.

As discussed above, the flexible package 100 may include a handle 104. The handle 104 may be sized to permit the flexible package 100 to be carried in the hand of a user. In addition, the handle 104 may be configured to add in conveying the flexible package 100. For instance, a plurality of flexible packages 100 may be stacked and the handle 104 may be used to remove a package 100 from the stack. In one arrangement, the handle 104 may be arranged on an end 106 of the flexible package 100. However, the handle 104 may be arranged on any side of the flexible package. Further, the handle 104 may be arranged horizontally or vertically anywhere along the panel of the package 100 to which it is attached. In one arrangement, the handle 104 may be arranged horizontally approximately ¾ of the way up the end 106 (i.e., in the top quarter of the end 106) of the package 100. In other arrangements, the handle 104 may be arranged midway up (i.e., approximately half way up) the end 106 of the package 100 or near the bottom of the end 106 of the package 100.

In addition, the flexible package 100 may include one or more openings or apertures 108. The aperture may be arranged on the same end 106 as the handle 104 or on any side of the flexible package 100. The aperture 108 may be configured to permit a user to insert a hook into the aperture 108, for instance, to remove the flexible package 100 from a high shelf or stack. Additionally or alternatively, a user may insert one or more fingers into the aperture 108 to move the package 100 or remove the package 100 from a stack or shelf.

Figure 3A:
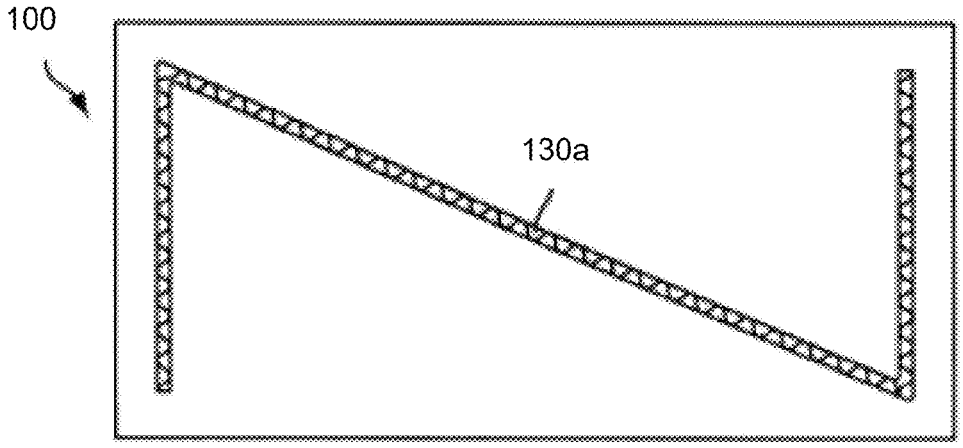
FIGS. 3A-3C illustrate various removable stiffening inserts that may be used with at least some flexible packages according to at least some aspects of this invention.
Figure 3B:
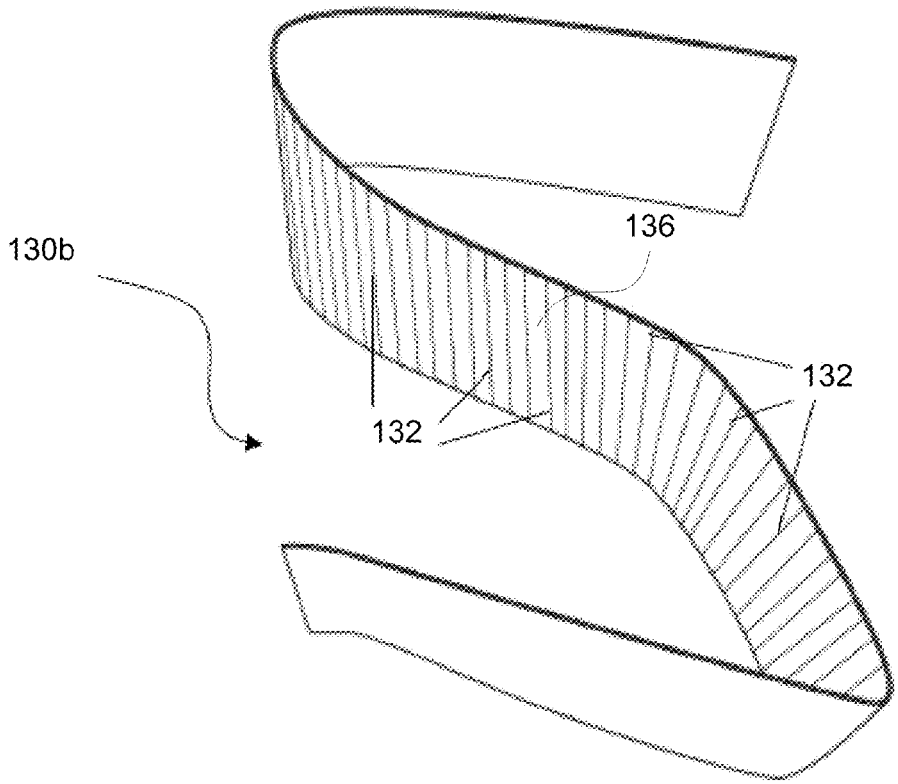
Figure 3C:
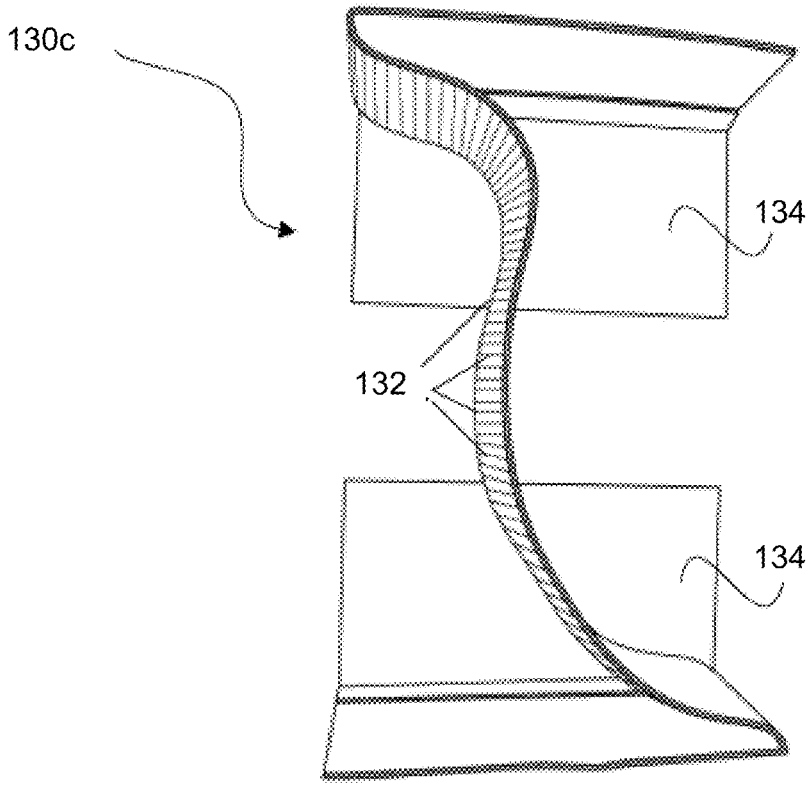

As mentioned above, some flexible package 100 arrangements may include a removable stiffening insert 130 to aid in adding structure and durability to the flexible package. FIGS. 3A-3C illustrate various arrangements of removable inserts 130 that may be used in conjunction with various flexible package arrangements.

FIG. 3A illustrates a top view of the flexible packaging 100 in an open configuration. A removable stiffening insert 130*a* is visible and may be used in conjunction with this arrangement in order to aid in maintaining the structure of the flexible package 100 and to aid in preventing the shoes from being crushed. The removable stiffening insert 130*a* illustrates one arrangement of a z-shaped removable stiffening insert 130*a*. The stiffening insert 130*a* may be placed within the void created by the flexible package 100 in order to maintain the structure of the flexible package 100 during storage, transport or conveyance of the footwear within the package 100. The z-shaped stiffening insert 130*a* can be removable and may also aid in preventing the articles of footwear from rubbing together or from becoming crushed when stored in the flexible packaging 100. In some arrangements, the stiffening insert 130*a* may be made of a material that is lightweight and generally stiffer than the material selected for the flexible packaging 100. For instance, the stiffening insert 130*a* may be formed of cardboard or other suitable material. The stiffening insert 130*a* may also include a color that may show through the flexible package 100 when used in conjunction with a flexible package that is translucent or transparent. In addition, the removable stiffening insert 130*a* may include information to identify the product within the package 200, such as a model name, style number, size, color and the like. This information may be included on the stiffening insert 130*a* when the stiffening insert 130*a* is used with a transparent flexible package 100.

FIGS. 3B and 3C depict an alternative arrangements for a removable stiffening insert 130 that may be used in conjunction with the flexible packaging arrangements described herein. Removable stiffening insert 130*b* of FIG. 3B is generally z-shaped. The stiffening insert 130*b* may be formed from any suitable material, such as paper, plastic, cardboard, and the like. In one arrangement, the stiffening insert 130*b* may be formed of corrugated cardboard. In addition, the stiffening insert 130*b* generally may include a plurality of indentations or ribs 132 formed along the length of the stiffening member. The ribs 132 may be formed on one or both sides of the stiffening insert 130*b* and may aid in allowing the stiffening insert 130*b* to flex in order to appropriately fit into the flexible package.

FIG. 3C illustrates yet another example removable stiffening insert 130*c*. The stiffening insert 130*c* may also be generally z-shaped. The stiffening insert 130*c* may also include a plurality of ribs 132 that aid in flexibility of the stiffening insert 130*c*. The ribs 132 may permit the stiffening insert 130*c* to be formed into variations of the general z-shape. For instance, the stiffening insert 130*c*, while maintaining a general z-shape, may be flexible and may include one or more bends to accommodate the products being stored in the flexible package. In addition, the removable stiffening insert 130*c* may include one or more bottom panels 134 configured to aid in conveying the stiffening insert 130*c* and/or the flexible package in which the insert is contained, during manufacture, assembly, distribution, etc.

In some arrangements, the removable stiffening insert 130 (including at least 130*a*-130*c*) may be configured to maintain its shape and configuration when acted on by a force in a first direction, and may collapse or compress, at least partially, when acted on by a force in a second direction. For instance, the removable stiffening insert 130 may be compressible, at least somewhat, in an X dimension (e.g., when positioned in a flexible package as shown in FIG. 1B) and may be stiff, strong and maintain its structure when acted on by a force in a Y dimension (as shown in FIG. 1B). This arrangement may provide the structural stability desirable in the flexible package, while providing flexibility to bend, e.g., around articles in the flexible package. In other words, a stiffening insert that was compressible in the Y dimension would collapse when stacked. This arrangement maintains its shape when stacked, either with other flexible packages or with conventional boxes.

In some examples, the removable stiffening insert 130 may have a longer than standard midsection (such as midsection 136 in FIG. 3B) in order to wrap around the articles within the flexible package 100 to provide additional protection to the articles and maintain the structure of the package and position of the articles within the package. In some arrangements, the midsection of the removable stiffening insert may follow the contour of the article within the flexible package. For instance, the midsection may follow the contour of one or more shoes within the flexible package. In some arrangements, the midsection may wrap around a toe portion of the shoe and/or may extend between the collar regions of the shoes.

In still other examples, the removable stiffening insert 130 may aid in maintaining the taughtness of the flexible package 100. For instance, the removable stiffening insert 130 may be arranged to stretch the flexible package 100 to a point in which some or all of the sides of the package 100 are taught. The removable stiffening insert 130 may create an internal skeleton for the flexible package 100. It thus aids in maintaining smooth surfaces for conveyance, storage, etc. of the flexible package 100 to avoid collapse or portions becoming caught in conveyor rollers, etc. as well as providing a crisp neat aesthetic appearance, similar to a conventional box.

In addition, the removable stiffening inserts 130 may provide internal structure without excessive additional weight and cost. The removable stiffening insert 130 may provide lightweight, low cost structure to the flexible package 100.

Further, the removable stiffening insert 130 may be formed of recyclable materials and, in some arrangements, may merely rest in the flexible package 100, rather than being attached thereto, in order to provide ease of removal for separation during recycling operations. Arrangements in which the removable stiffening insert 130 is not attached to the flexible package 100 further aid in ease of recycling because various adhesives, and/or other attachment means that may be used, may result in additional cost to recycle or may preclude the material from being recycled.

Further, in arrangements in which the removable stiffening insert 130 may not be attached to the flexible package 100, the removable insert 130 may permit at least some compression (on an X-axis or in an X dimension as shown in FIG. 1B) in order to slightly deform the flexible package 100 when packed together, for instance, in a master shipping container. Denser packing of the flexible packages permits additional units to be packed in a single master container, thereby saving shipping volume, cost, and environmental impact associated with shipping (energy, pollution of transportation, etc). Lightweight, conformable flexible packages may function in the supply chain like a convention box, but deliver the packing advantages of conventional bags.

Figure 4:
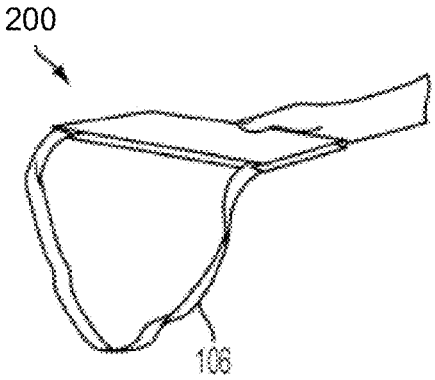
FIG. 4 illustrates the flexible package in a collapsed configuration, according to at least some aspects of this invention.

One additional advantage of the flexible packaging described is that the package may be collapsed or be compressed during non-use, as shown in FIG. 4. Although the arrangements shown in FIGS. 4 and 5 generally illustrate a messenger style bad (i.e., a bag that is taller than it is wide) the compressibility of the package shown may be used in conjunction with any of the flexible packages described herein and at least those shown in FIGS. 1A-3C and 6A-10B, and described herein.

Figure 5:
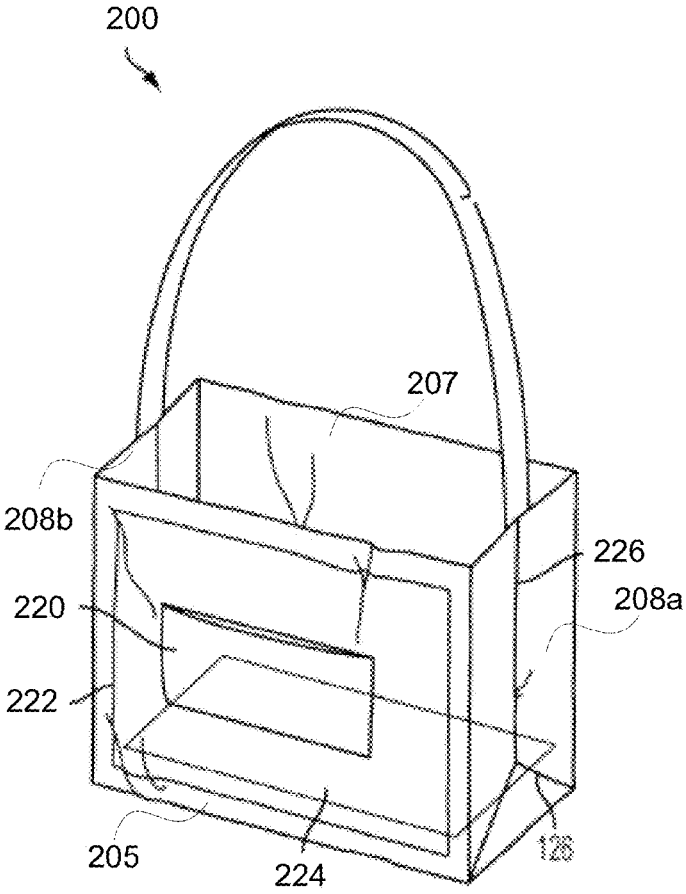
FIG. 5 illustrates the flexible package of FIG. 4 in an expanded configuration according to at least some aspects of this invention.

With further reference to FIGS. 4 and 5, in order to collapse the flexible package, the side panels 208*a*, 208*b* of the flexible package 200 may include one or more creases or fold lines 226 that allows the flexible package 200 to flatten, fold, or collapse to a smaller size. In the expanded configuration, the flexible package 200 would provide access to the void created by the flexible package 200 and sized to accommodate the footwear or other articles being stored therein. In a collapsed configuration, the side panels 208*a*, 208*b* may fold to bring the front and rear panels 205, 207 together to minimize the void, thereby reducing the amount of space taken up by the flexible packaging 200 (e.g., in a manner akin to the manner that a conventional grocery bag folds down and flattens). The creases or fold lines may also be seams in the flexible package 200. Arranging the seams on the side panels maintains the flat surface of the front and rear panels to aid in stacking and conveying the flexible packages 200. In addition, these seams may also add structure to the flexible package 200 and aid in maintaining the expanded configuration of the flexible package 200, as desired. In some examples, the seams may reduce or eliminate the need for additional structures to add stability, such as a stiffening insert.

In some arrangements, one or more of the panels may be gusseted to reinforce the flexible package to aid in maintaining the structure of the package. In some arrangements the flexible package 200 may include a frame portion to maintain the structure of the flexible package as needed. Additionally or alternatively, a removable stiffening insert (222, 224 in FIG. 5) may be inserted into the flexible package 200 to aid in maintaining the shape of the package 200. For instance, one or more pieces of a material stiffer than the plastic used for the flexible packaging 200, e.g., cardboard, may be inserted into the flexible package 200 to stiffen one or more sides of the flexible package 200. The removable stiffening insert 222, 224 may aid in adding structure to the flexible package 200 for stacking the flexible packages 200 during storage, may aid in maintaining a stable base for conveyance, and may aid in preventing the shoes from being crushed when packages 200 are arranged in a stacked configuration. The stiffening insert 222, 224 may be removable, e.g., if necessary or desired to allow the flexible packaging 200 to collapse or fold. In some arrangements, the stiffening insert 222, 224 can be stored within the collapsed flexible packaging 200 during storage.

In addition, the removable stiffening insert 222, 224 can include a product logo or other product description or information. In particular, this arrangement could be used when the flexible packaging 200 is a transparent material. The stiffening insert 222, 224 can include information such as product name, style number, size, manufacturer's logo, branding information, and the like. The information could then be viewed through the transparent flexible packaging 200.

The flexible package 200 may also include one or more pockets 220 configured on the inside or outside of the flexible package 200, as shown in FIG. 5. The pocket 220 may be integrally formed with the flexible package 200. Alternatively, the pocket 220 may be formed as a separate piece and connected to the main body of the flexible package 200 using known methods of attachment, such as adhesives, stitching, and the like. The pocket may be used to hold literature or other product information associated with the footwear or other article contained within the flexible package 200.

As discussed above, one or more panels of the flexible package may be configured to open, thereby permitting access to the void created by the flexible package. Various closure arrangements are discussed below that may be used to secure the panel and/or other panels of the flexible package.

Figure 6A:
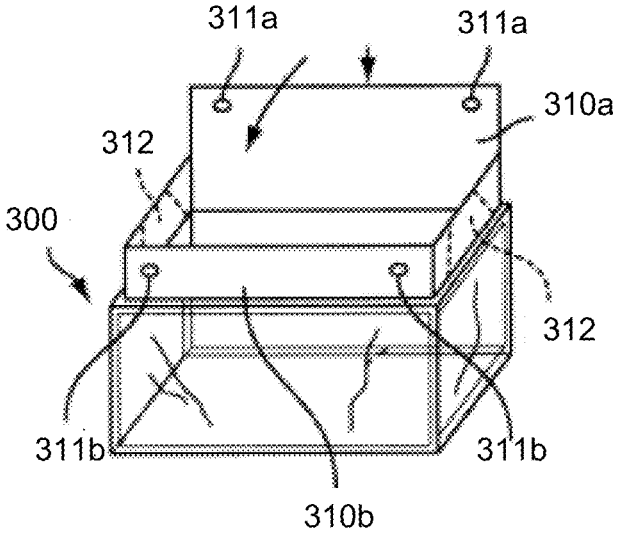
FIGS. 6A-6C illustrate various configurations of the alternate arrangement of the flexible package for footwear according to aspects of this invention.
Figure 6B:
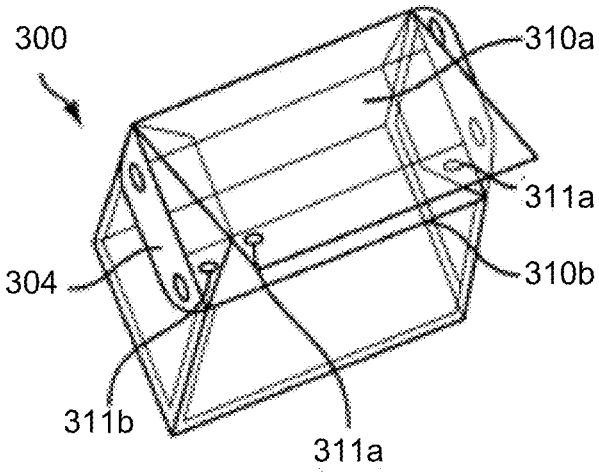
Figure 6C:
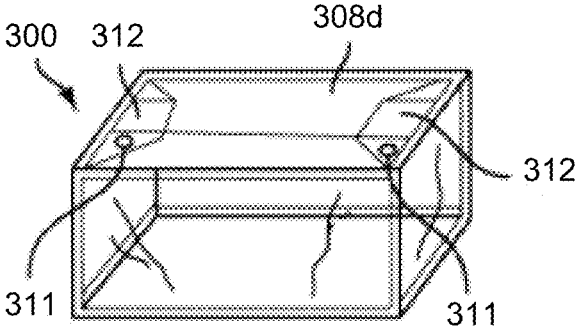

FIGS. 6A-6C illustrate one closure option for the flexible package described herein. In FIG. 6A, the flexible package 300 is shown in an open configuration. As shown, the top panel (308*d* in FIG. 6C) is flexed to a vertical position to allow access to the interior of the flexible package 300. The top panel 308*d* of the flexible package 300 includes a main rear flap 310*a* and two side flaps 312 that will fold inward to cover a portion of the void created by the flexible package 300 in a closed configuration. These side flaps 312 aid in closure of the flexible package 300. In addition, the side flaps 312 aid in preventing debris or other materials from entering the flexible package 300 and aid in preventing any objects contained within the flexible package 300 from falling out.

In addition to the side flaps 312, the top panel 308*d* includes a front closure flap 310*b* that flexes inward to cover a portion of the void created by the flexible package 300 in a closed configuration. Similar to the side flaps 312, the front closure flap 310*b* aids in preventing debris from entering the flexible package 300 and aids in preventing the contents of the flexible package 300 from falling out. Further, the front closure flap 310*b* may include a portion of the closure mechanism 311 used to secure the top panel 308*d* in a closed configuration. For instance, front closure flap 310*b* includes closure mechanisms 311*b* which correspond to closure mechanisms 311*a* on the rear flap 310*a*. The closure mechanism 311 may be any known method of securing one flap to another and will be discussed further below.

FIG. 6B illustrates the flexible packaging 300 for footwear in a partially closed configuration. The rear flap 310*a* is folded inward to cover a substantial portion of the void created by the flexible packaging 300. In addition, FIG. 6B shows the closure mechanism 311*a* of the top flap aligning with the closure mechanism 311*b* of the bottom closure flap. FIG. 6B further illustrates one potential arrangement of a handle 304. The handle 304 may be generally positioned on a side of the package that may be exposed during transport, storage or conveyance of the flexible package 300. The handle 304 can act as a pull for a user to move the package 300 or to remove the package 300 from a stack of flexible packages 300. As mentioned above, in some arrangements, the handle 304 may be relatively taught and may be flush with the package when not in use (i.e., when a hand is not engaging the handle).

FIG. 6C shows the flexible package 300 for footwear or other articles in a closed configuration. As shown, the side flaps 312 are folded inward to cover a portion of the void created by the flexible package 300. In addition, the front closure flap (not labeled in FIG. 6C) is also folded inward to cover a portion of the void. Finally, the rear flap 310*a* is folded inward to cover a substantial portion of the void created by the flexible package 300 and together with the side flaps 312 and front closure flap 310*b* forms the top panel 308*d*. The closure mechanism 311*a* of the rear flap 310*a* is aligned with the closure mechanism 311*b* of the front closure flap 310*b* to secure the top panel 308*d* in the closed configuration.

Figure 7:
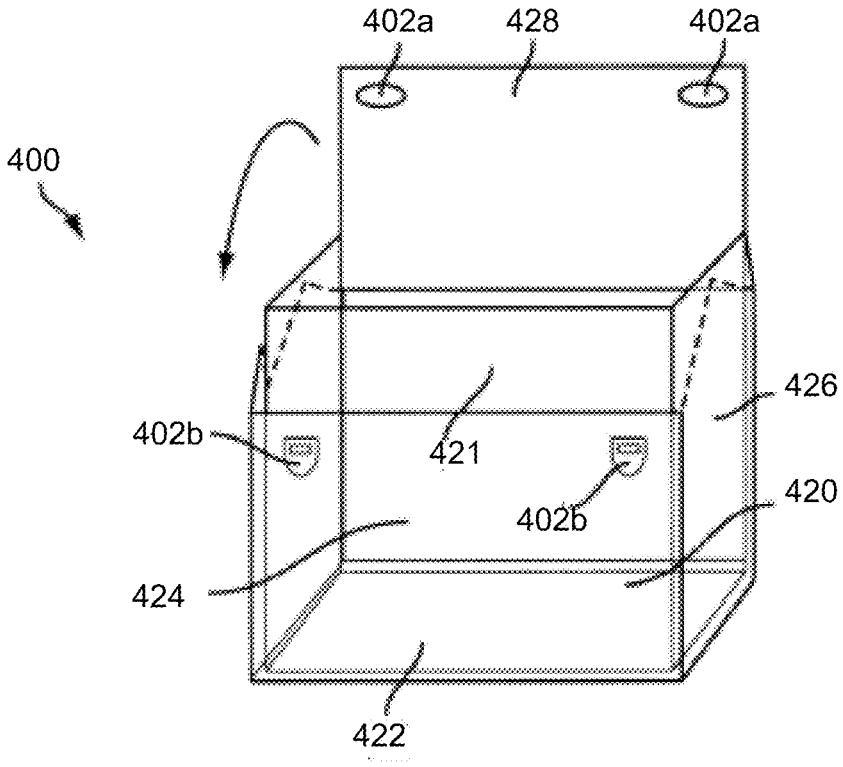
FIG. 7 illustrates one example closure arrangement that can be used with various flexible package arrangements according to at least some aspects of this invention.

FIG. 7 illustrates an alternate closure arrangement for a flexible package 400. The flexible package 400 of FIG. 7 includes a main body portion 420 having a front panel 422, a rear panel 424 and a plurality of side panels 426. The top panel of FIG. 7 includes a rear flap 428 that is sized to cover the void created by the flexible package 400 and to extend a predetermined length down the front panel 422 of the flexible package 400. The rear panel 428 includes one or more apertures 402*a* configured to secure the rear flap 428 when coupled to an undercut tab 402*b*. A shorter front flap 421 may also be included. In order to close the flexible package 400, the rear flap 428 is folded forward, toward the front panel 422 of the flexible package 400. The apertures 402*a* of the rear flap 428 are pulled over the lower, free end of the undercut tab 402*b*. Once the lower portion of the aperture 402*a* is over the free end of the undercut tab 402*b*, the rear flap 428 is released and the connection point of the tab 402*b* catches the aperture 402*a* to secure the rear flap 428 in the closed position. In order to open the flexible package 400, the rear flap 428 is pulled downward to pull the apertures 402*a* around the lower, free end of the undercut tab 402*b* to release the rear flap 428.

Figure 8A:
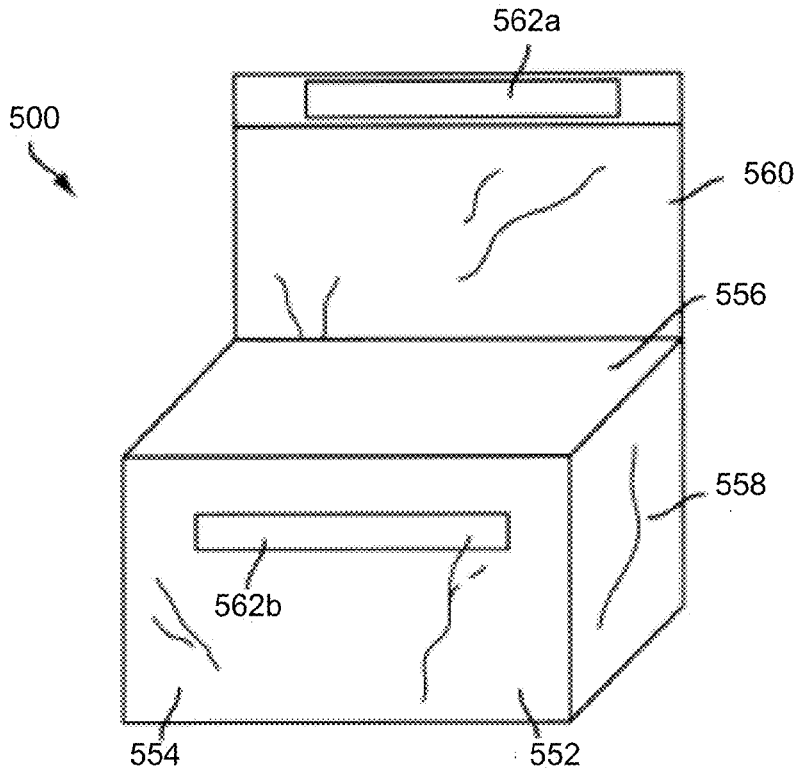
FIGS. 8A and 8B illustrate other example closure arrangements that can be used with various flexible package arrangements according to at least some aspects of this invention.
Figure 8B:
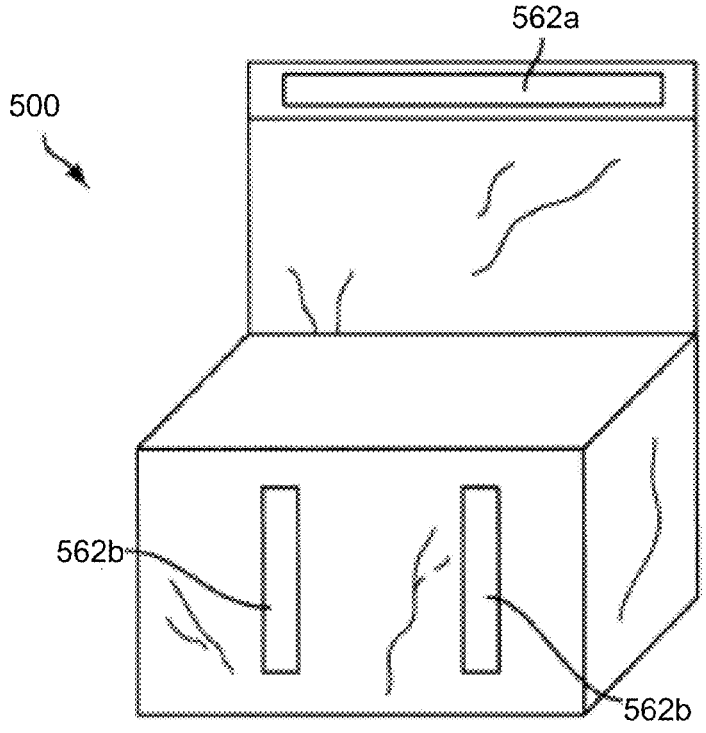

FIGS. 8A and 8B illustrate yet another closure arrangement for a flexible package 500. The flexible package 500 of FIGS. 8A and 8B include a main body portion 552 having a front panel 554, a rear panel 556 and a plurality of side panels 558. In addition, the top panel includes a rear flap 560. The rear flap 560 includes a hook and loop type closure 562*a*, such as VELCRO. In the arrangement of FIG. 8A, the front panel 554 includes a corresponding hook and loop type closure 562*b*. As shown, the front panel 554 includes one or more hook and loop type closures 562*b* arranged in a horizontal configuration. In order to close the flexible package 500, the rear flap 560 is folded forward, toward the front panel 554 of the flexible package 500, and secured to the corresponding hook and loop closure 562*b* connected to the front panel 554. In the arrangement of FIG. 8B, one or more hook and loop closures 562*b* are connected to the front panel 554 in a vertical configuration. This arrangement allows increased adjustability when closing the flexible package 500. For instance, the rear flap 560 can be folded forward to cover the void created by the flexible package 500 and can extend to varying lengths along the hook and loop closure 562*b* connected to the front panel 554 to permit objects of varying size to be stored in the flexible package 500.

Figure 9A:
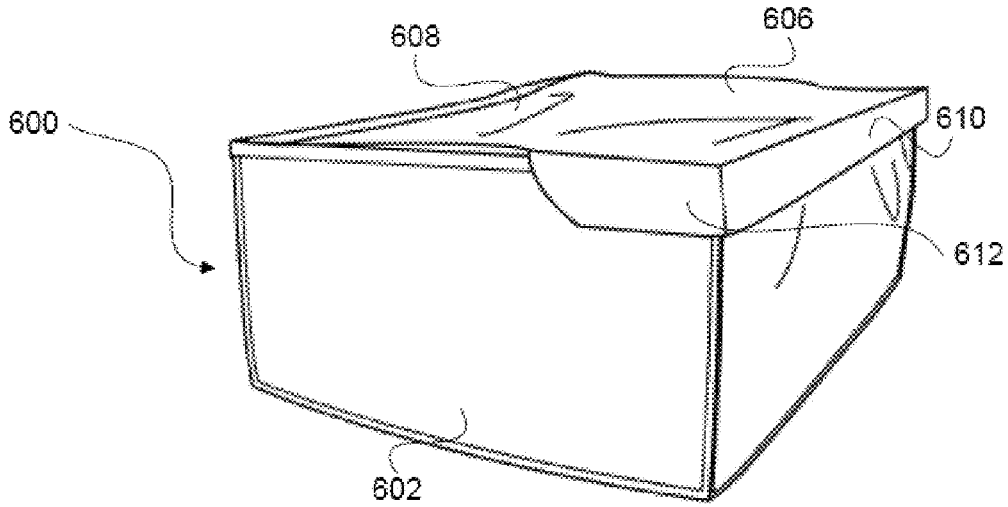
FIGS. 9A and 9B illustrate closed and open configurations, respectively, of another arrangement of a flexible package according to at least some aspects of this invention.
Figure 9B:
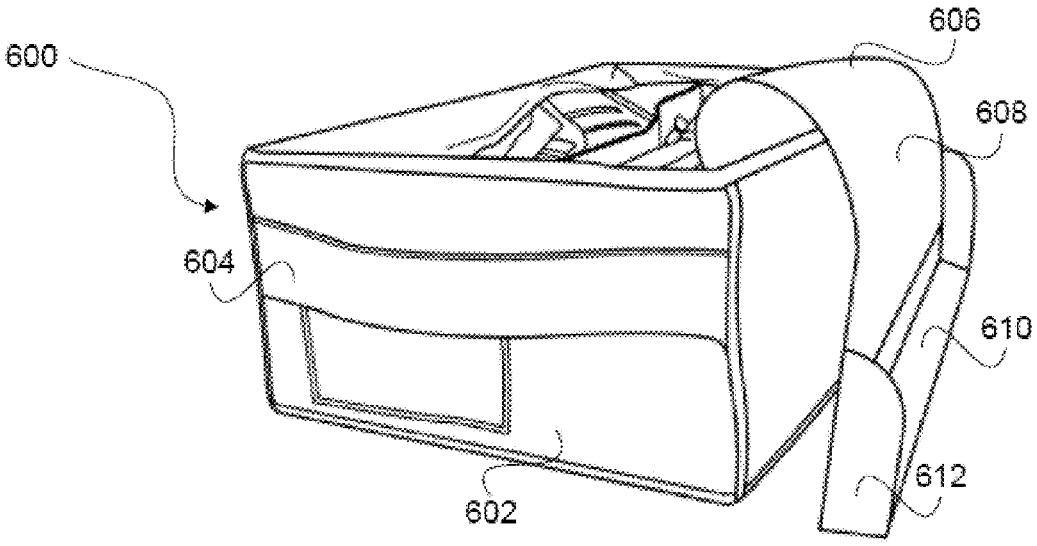

FIGS. 9A and 9B illustrate yet another closure arrangement for use with one or more flexible packaging arrangements described herein. The flexible package 600 includes a body portion 602 and a handle 604. In addition, the flexible package 600 includes a lid portion 606. FIG. 9A illustrates the lid portion 606 in a closed position while FIG. 9B illustrates the lid portion 606 in a substantially open position. The lid 606 includes a flexible interior section 608 and a rigid end area 610. The flexible interior section 608 may be formed of the same or similar materials as the remainder of the flexible package 600. The rigid end portion 610 may be formed of material that is substantially more rigid than the flexible interior portion 608. For instance, the rigid end portion 610 may be formed of cardboard, such as corrugated cardboard. The rigid end portion 610 may also include a lip or overhang 612. The lip 612 may extend along one or more edges of the lid portion 606. The lip 612 may include one or more corners.

In one arrangement, the lip 612 may aid in closure of the flexible package 600. For instance, the lip 612 may be formed to fit tightly to a corresponding portion of the body 602 of the flexible package 600. This arrangement may also for essentially a friction type fit that maintains the lid 606 in a closed position until enough force is exerted on the lid 606 to open the lid 606. Additionally or alternatively, the lip 612 may include an adhesive that may adhere to the main body 602 of the flexible package 600 itself or to a corresponding adhesive on the main body 602. In still other arrangements, the lip 612 may include a catch, ridge or rim (not shown) on the underside of the lip 612 that may extend over a corresponding catch, ridge or rim arranged on the main body 602 of the flexible package.

Some or all of the closure mechanisms described herein may close or seal the flexible package such that any surfaces of other containers (e.g., other flexible packages, conventional boxes, etc.) that slide past one another when the packages are stacked, conveyed, etc. and do not catch on each other. For instance, the closure mechanisms may minimize or eliminate any protrusions that may be associated with closure of the package in order to avoid catching on other packages. Additionally or alternatively, the closure mechanism of the packages may maintain its closed configuration until opened in order to maintain the geometric integrity of the package so that it does not bind or lodge itself on the conveyance equipment of a distribution facility, and/or does not collapse when multiple packages are stacked one on top of another.

Additional known methods of closure may also be used in conjunction with the flexible packages for shoes described herein without departing from the invention. For instance, a plurality of buttons or snaps may be used to secure the top panel. Alternatively, a resealable adhesive may also be used. As yet another example, if desired, a magnetic closure system may be used.

Figure 10A:
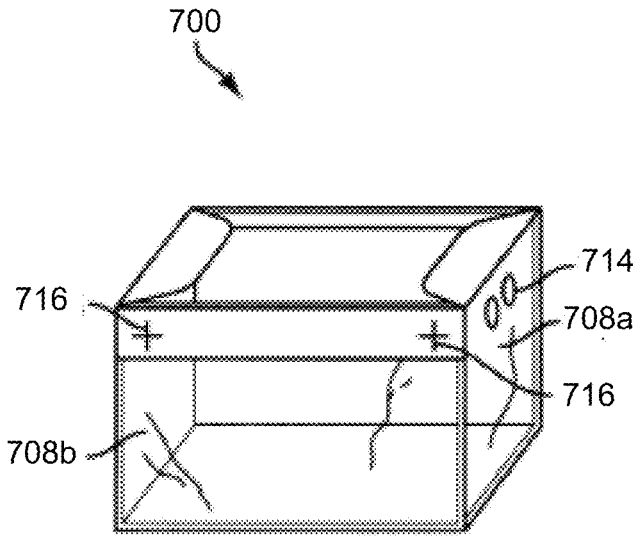
FIGS. 10A and 10B illustrate various alternate handle connection arrangements that may be used with the flexible package according to at least some aspects of this invention.
Figure 10B:
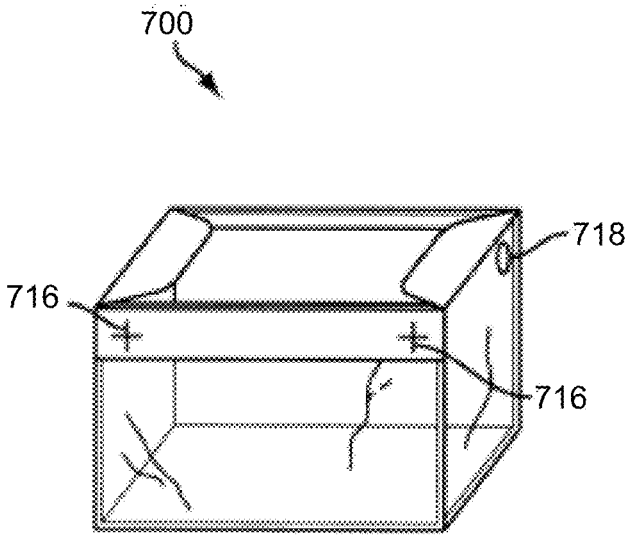

FIGS. 10A and 10B illustrate two alternate handle (not shown) location and connection points for the flexible package 700 for footwear or other articles described herein. FIG. 10A illustrates a two hole arrangement in which the handle (not shown) would be connected at an upper portion of the vertical side panel via the two holes 714 or connection points. In this arrangement, the handle would be connected on each side in the center of the vertical side panels 708*a*, 708*b* (e.g., by extending a portion of handle through the holes 714, for example, akin to the manner in which a button engages a button hole). If desired, the portion of the handle extending through the holes 714 may include a loop, opening, or other structure, to act as the secondary handle, as will be described in more detail below. FIG. 10B illustrates an alternate arrangement in which one hole 718 or connection point is used to connect the handle. The single hole 718 or connection point is arranged in the upper right or upper left corner of the vertical side panels 708*a*, 708*b*. A corresponding connection point or hole is then arranged in the upper right or upper left corner of the opposite vertical side panels 708*a*, 708*b*. The handle would then extend diagonally across the top panel of the flexible package 700 from one corner to an opposite corner.

FIGS. 10A and 10B also indicate closure points 716. The closure points 716 may include a variety of different closure systems that will be discussed more fully below.

The arrangements of the flexible package for footwear described above may be constructed in varying sizes. For instance, the flexible packages can be sized to accommodate any size footwear, including children's sizes and adult sizes. In addition, the overall size and configuration of the flexible package can be formed to accommodate women's shoes and men's shoes, as well as varying widths and heights of shoes within those categories.

The arrangements of the flexible package for footwear described above can be formed of any suitable material that is lightweight and flexible, such as heavyweight paper. In addition, the material or materials used may be selected for their water repellent properties. For instance, any suitable flexible plastic or thermoplastic can be used to form the flexible package, such as polyester plastic films, polypropylene (such as high density polypropylene (HDPP)), polyethylene (such as high density polyethylene (HDPE)), polylactic acid, and the like. Additionally or alternatively, the materials used in forming the flexible packaging may include textiles or sheet film. These materials may be woven or non-woven. In some arrangements, the flexible package may be formed of woven plastic with a suitable coating to prevent wear, add water repellency, etc. In still other arrangements, the materials used to form the flexible package may be selected based on the environmental impact. For instance, materials may be used that are biodegradable or are produced from biopolymer sources.

The flexible packaging arrangements for footwear described herein may be formed of a transparent material to permit the footwear within the package to be seen from outside the package. Additional packaging colors and/or finishes may be used. For instance, the flexible package may be translucent or opaque. In addition, the flexible packaging could be any color desired by the manufacturer. In one example, the color of the flexible packaging may be selected based on a particular color generally associated with the footwear manufacturer. In addition, in some arrangements, a combination of finishes may be used. For instance, portions of the flexible package may be transparent, while other portions may be opaque or may include a region where information may be printed to identify the footwear within the flexible package. That is, the flexible packaging for footwear may include a label region where information may be printed directly on the flexible packaging or where a separate label may be placed.

In addition, the flexible package may be formed as a single piece or the panels of the flexible package may be formed separately and joined using known methods of joining, such as welding (i.e., heat welding, radio frequency welding, ultrasonic welding, and the like), stitching, adhesives, and the like. In some arrangements, some panels of the flexible package may be formed as a single piece while others are formed separately and joined using the above described methods of joining.

The arrangements of flexible packaging for footwear described above are lightweight alternatives to conventional footwear boxes. The flexible packaging also includes less waste in the shipping, storage and display of footwear than conventional shoe boxes and may be formed of recyclable materials to further reduce waste. In addition, the flexible packaging generally occupies less space because it can be collapsed during non-use. In some arrangements, the flexible packaging may be configured to be slightly compressed in certain arrangements, i.e., when several flexible packages are shipped in a large container, the flexible packages may be compressed to fit a greater number of packages into the container than would be possible with conventional shoe boxes. In addition, the articles stored in the flexible packaging described may be stored alongside articles in conventional packaging, without requiring modifications to storage units, such as shelves, display units, and the like.

The arrangements described herein with respect to flexible package and as shown in FIGS. 1A-10B may be used in various combinations and the features are not limited to use solely within the particular figure or arrangement with which it is described.

CONCLUSION

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A flexible package for articles of footwear, comprising:

a front panel and a rear panel;

a bottom panel joining the front and rear panels along a first bottom edge and a second bottom edge;

two side panels joining the front and rear panels along a first side edge and a second side edge;

a top closure structure joining the front and rear panels along a first top edge and a second top edge, the top closure structure including:

a front flap extending from the front panel;

two side flaps; and a rear flap extending from the rear panel and across a void formed by the flexible package when in a closed configuration;

wherein the front flap, two side flaps and rear flap are configured to fold inward to enclose the void formed by the flexible package, wherein the rear flap includes a first portion of a closure mechanism configured to fasten the top closure structure in the closed configuration, and wherein the front panel, the rear panel, the two side panels, the front flap, the two side flaps, and the rear flap are formed from a plastic film material or a textile material; and a removable stiffening insert provided in the void, wherein the removable stiffening insert includes a z-shaped portion having a top wall, a bottom wall, and a diagonal wall connecting the top wall and the bottom wall, and wherein the removable stiffening insert includes a first panel folded from the top wall and extending toward the bottom wall and a second panel folded from the bottom wall and extending toward the top wall.

2. The flexible package of claim 1, wherein the closure mechanism is at least one of a hook and loop fastener, an undercut tab and an aperture, an adhesive, and a snap.

3. The flexible package of claim 2, further including a secondary handle arranged on a side of the flexible package.

4. The flexible package of claim 1, further including a handle configured to be carried in the hand of a user.

5. The flexible package of claim 1, wherein the closure mechanism includes an undercut tab.

6. The flexible package of claim 1, wherein the closure mechanism includes two undercut tabs.

7. The flexible package of claim 1, wherein the closure mechanism includes a first closure mechanism on a first side of the flexible package and a second closure mechanism on a second side of the flexible package.

8. The flexible package of claim 1, wherein the closure mechanism includes a tab provided on the front panel and an aperture provided on the rear flap, wherein the aperture engages the tab to secure the rear flap to the front panel.

9. The flexible package of claim 1, wherein the closure mechanism includes: (a) a first tab provided on the front panel, (b) a first aperture provided on the rear flap, (c) a second tab provided on the front panel, and (d) a second aperture provided on the rear flap, wherein the first aperture engages the first tab and the second aperture engages the second tab to secure the rear flap to the front panel.

10. The flexible package of claim 1, wherein the removable stiffening insert is arranged between the front and rear panels, and wherein the diagonal wall extends in a diagonal direction across the void.

11. The flexible package of claim 10, wherein the removable stiffening insert is formed of a flexible material.

12. The flexible package of claim 11, wherein the removable stiffening insert is formed of a recyclable material.

13. The flexible package of claim 1, wherein the removable stiffening insert provides interior structure to the flexible package.

14. The flexible package of claim 13, wherein the removable stiffening insert stretches the flexible package to a taut condition.

15. The flexible package of claim 1, wherein the removable stiffening insert further includes a panel extending from the top wall.

16. The flexible package of claim 1, wherein the removable stiffening insert further includes a first panel extending from the top wall and a second panel extending from the bottom wall.

17. The flexible package of claim 16, wherein the removable stiffening insert is formed of a flexible material.

18. The flexible package of claim 16, wherein the removable stiffening insert provides interior structure to the flexible package.

19. The flexible package of claim 18, wherein the removable stiffening insert stretches the flexible package to a taut condition.

20. The flexible package of claim 1, wherein the removable stiffening insert is arranged between the front and rear panels, and wherein the diagonal wall extends in a diagonal direction across the void.

21. The flexible package of claim 20, wherein the removable stiffening insert is formed of a flexible material.

22. The flexible package of claim 1, wherein the removable stiffening insert provides interior structure to the flexible package.

23. The flexible package of claim 22, wherein the removable stiffening insert stretches the flexible package to a taut condition.

24. The flexible package of claim 1, wherein the front flap of the top closure structure includes a second portion of the closure mechanism configured to fasten the top closure structure in the closed configuration.

25. The flexible package of claim 24, wherein the first portion and the second portion of the closure mechanism are aligned on a top surface of the flexible package when in the closed configuration.

* * * * *